US006641895B1

(12) United States Patent
Adams

(10) Patent No.: US 6,641,895 B1
(45) Date of Patent: Nov. 4, 2003

(54) HEAT STAKED MAGNET IN MULTI-PIECE HOUSING

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 10/313,829

(22) Filed: Dec. 6, 2002

(51) Int. Cl.[7] ..... B32B 3/10
(52) U.S. Cl. ..... 428/133; 428/134; 428/542.2
(58) Field of Search ..... 428/131, 133, 428/134, 542.2

(56) References Cited

U.S. PATENT DOCUMENTS 3,765,072 A 10/1973 Vollet
4,767,298 A 8/1988 Bocchicchio et al.
5,025,581 A * 6/1991 Polzin ..... 40/159
5,059,746 A 10/1991 Hayes et al.
5,340,634 A 8/1994 Adams
5,495,686 A * 3/1996 Millard et al. ..... 40/621
5,749,885 A 5/1998 Sjostrom et al.
6,153,070 A 11/2000 Maurer et al.
6,158,792 A 12/2000 Snider
6,179,268 B1 1/2001 Seid
6,296,470 B1 10/2001 Lanser et al.

* cited by examiner

*Primary Examiner*—Cathy Lam
(74) *Attorney, Agent, or Firm*—Buchanan Ingersoll, P.C.

(57) ABSTRACT

A decorative magnet has a plastic body with at least one magnet heat staked to the back of the body. The body has at least one opening extending through the body from the front face to the back and a stake extending from the back of the body. An insert has a first portion within the at least one opening and a second portion extending from the first portion. The second portion rests against the back of the body and prevents the insert from completely passing through the opening. A portion of the magnet covers at least a portion of the insert thereby retaining the insert within the opening or openings in the body.

22 Claims, 7 Drawing Sheets

HEAT STAKED MAGNET IN MULTI-PIECE HOUSING

BACKGROUND

1. Field of the Invention

The invention relates generally to decorative magnets in which a magnet is contained in a plastic housing having a decorative shape that may be used to mount papers and other objects on a metal surface such as a refrigerator door or filing cabinet.

2. Description of Related Art

Decorative magnets are well known in the art. They typically have a molded plastic body configured in a decorative shape and a magnetic base for holding the decorative body against a metal surface. Many of the bodies are one piece and some are painted. Others are multi-piece, usually consisting of a main body or base to which other pieces are attached. These pieces may be glued to the main body or snap fit into holes in the main body. For example, my U.S. Pat. No. 5,340,634 discloses a magnet having a cylindrical molded body with a nose and mouth molded on the flat, outer surface. A magnet is attached to the back of the body by a screw or rivet. Eyes are either molded into the front or are separate pieces that are snap fit into holes in the body. There are two major shortcomings with this product. First, the entire body can only be made in a single color unless expensive molding procedures are used. Second, if the eyes are separately attached they can be different in color from the body but the hand assembly adds significant cost to the product relative to the overall costs of production. Thus, there is a need for a decorative magnet that can be made of multiple pieces of different colors that can be easily and inexpensively assembled.

SUMMARY OF INVENTION

I provide a decorative magnet in which a magnet is heat staked onto a body having a front face and a back. The body has at least one opening extending through the body from the front face to the back and a stake extends from the back of the body. An insert has a first portion within the at least one opening and a second portion extending from the first portion. The second portion rests against the back of the body and prevents the insert from completely passing through the opening. A magnet is placed on the stake such that the stake passes through a hole in the magnet. The end of the stake is heated to heat stake the magnet on the stake. A portion of the magnet covers at least a portion of the insert thereby retaining the insert within the at least one opening. No gluing or snap-fit connections are needed.

DESCRIPTION OF THE PREFERRED EMBODIMENTS

Figure 1:
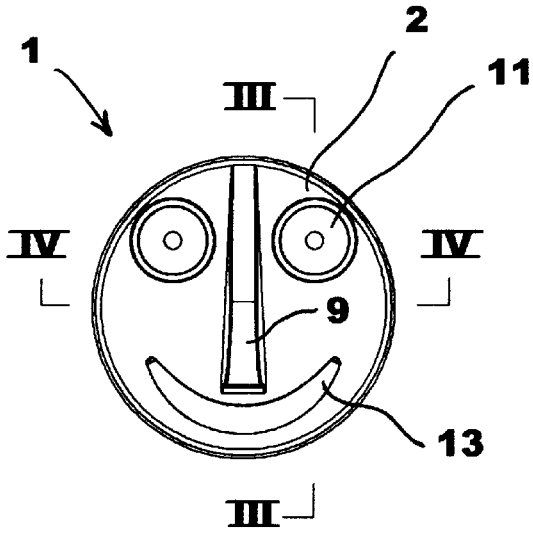
FIG. 1 is a front view of a first present preferred embodiment.
Figure 2:
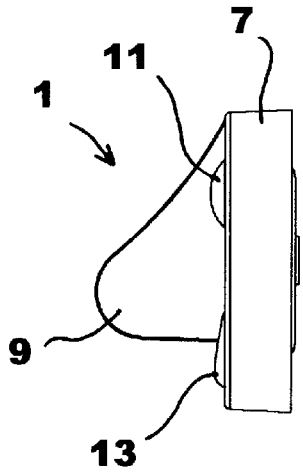
FIG. 2 is a side view of the embodiment shown in FIG. 1.
Figure 3:
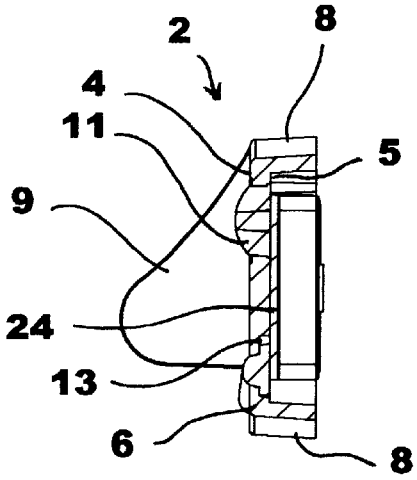
FIG. 3 is a sectional view taken along the line III—III in FIG. 1.
Figure 4:
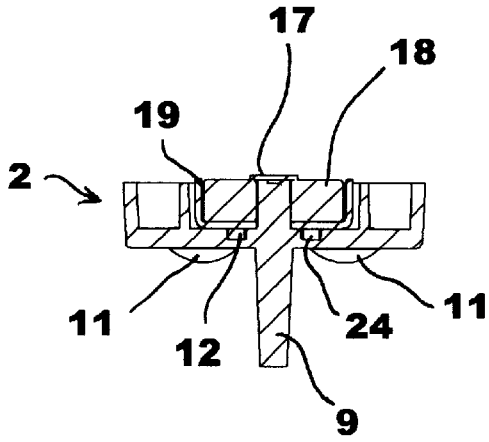
FIG. 4 is a sectional view taken along the line IV—IV in FIG. 1.
Figure 5:
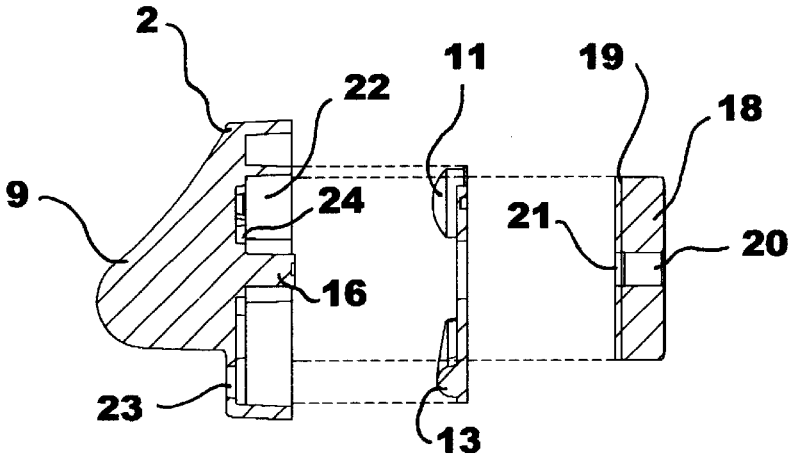
FIG. 5 is a exploded sectional view similar to FIG. 3.
Figure 6:
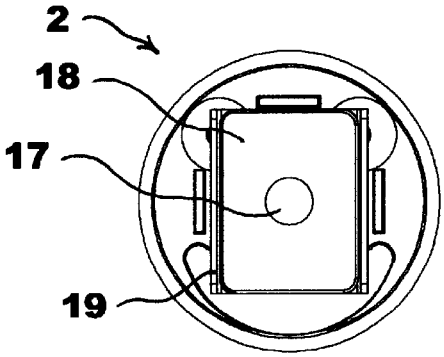
FIG. 6 is a rear view of the embodiment shown in FIG. 1.
Figure 7:
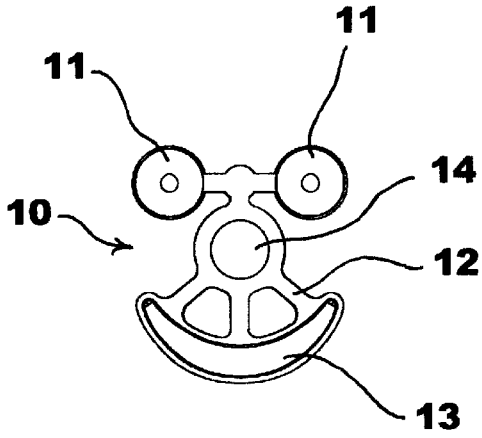
FIG. 7 is a top plan view of the insert used in the embodiment of FIG. 1.

A first present preferred embodiment 1 of my heat staked magnet in a multi-piece plastic housing is shown in FIGS. 1 through 7. That product has a plastic body 2 having a front surface 4 and rear surface 5 on a flat, round base 6. A side wall 8 extends rearward from the perimeter of the base. The front surface alone or the front surface 4 and outer surface of the side wall 8 may form a face. A nose 9 extends from the front surface and a stake 16 extends from the rear surface. The body, nose and stake are molded as a single piece. The eyes 11 and mouth 13 are formed by an insert 10 shown in FIG. 7. The insert 10 has a bridge 12 that connects the two eyes 11 and mouth 13. There is a hole 14 in the bridge which allows the insert to be fitted over the stake 16. As can be seen most clearly in FIG. 5, the eyes 11 fit through holes 22 in the body 2. The mouth 13 fits through hole 23 in the body. The holes 22 and 23 may be stepped or tapered so that light does not pass around the eyes or mouth. The bridge 12 is nested in a channel 24 cut in the rear surface 5 of the body 2. After the insert 10 is positioned on the body so that the portion of the insert forming the eyes and the portion of the insert forming the mouth extend through the holes 22 and 23, a magnet 18 carried in magnet holder 19 is placed over the insert. Then the stake 16 will extend through holes 21 and 22 in the magnet holder 19 and magnet 18. Next a hot iron is pressed against the end of stake 16 to melt that end into a head 17 thereby heat staking the magnet 18 to the body 2. Since the insert 10 is between the body and the magnet the magnet retains the insert within the body 2. If the insert is fully within the holes 22 and 23 and channel 24, the magnet holder 19 carrying magnet 18 will be flush against the rear surface of the body 2. A significant advantage of the present decorative magnet is that the insert can be quickly dropped into place. The channel aids in assuring that the insert is properly oriented. The magnet can then be positioned on the stake and heat staked in place. These operations can be done very quickly by hand. Furthermore, this assembly process could easily be automated at relatively low cost.

Figure 8:
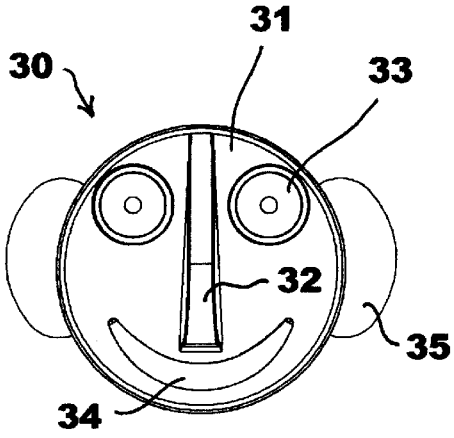
FIG. 8 is a top plan view of a second present preferred embodiment.

Another significant advantage of the present invention is that other inserts could be used to add features to the perimeter of the body. Examples of such features are shown in the embodiments illustrated in FIGS. 8 through 18. In a second present preferred embodiment 30 shown in FIG. 8 there is a plastic body 31 with molded nose 32. Eyes 33 and mouth 34 could be molded into the plastic body or formed by an insert as in the first embodiment. Ears 35 are added by creating an insert similar to that shown in FIG. 7 in which a bridge (not shown) connects the two ears 35 together. Slots (not shown) are cut in the side wall of the body 31 to receive the bridge. When the magnet is attached to the rear of the body 31 it covers at least a portion of the bridge securing the ears 35 to the plastic body 31.

Figure 9:
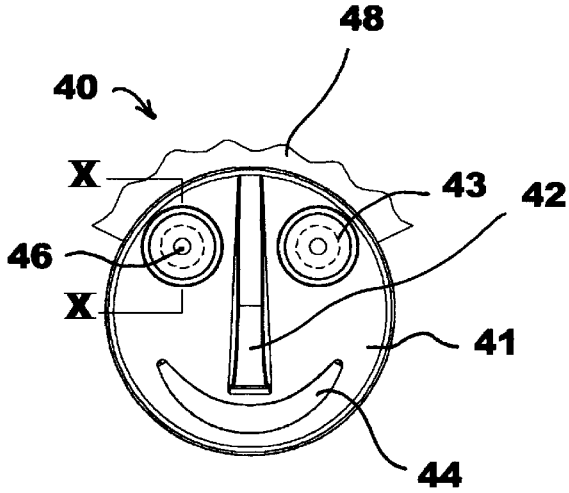
FIG. 9 is a top plan view of a third present preferred embodiment.
Figure 10:
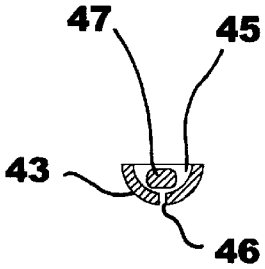
FIG. 10 is a sectional view taken along the line X—X in FIG. 9.

A third present preferred embodiment 40 is shown in FIGS. 9 and 10. That embodiment has a plastic body 41 with molded nose 42. Eyes 43 and mouth 44 are provided by an insert similar to insert 10 in the embodiment of FIG. 1. A second insert is provided to add hair 48 to the top of body 41. This insert will be much like the insert used in the embodiment of FIG. 8. One or more bridges (not shown) extend from the hair through slots in the side wall of the body 41. A portion of the bridges would be covered by the magnet retaining the insert in place on the body. The third embodiment 40 has eyes 43 which have a cavity 45. The eyes are formed of a transparent or translucent plastic. Within cavity 45 there is provided a ball or similarly shaped insert 47. That ball may be a dark plastic bead of any selected color. Finally, a hole 46 is cut in the eye 43 to simulate a pupil. When assembled, the magnet would fit over the eyes thereby closing cavity 45 and retaining the insert 47 within that cavity. This same body 41 could be used to make an angel by adding a halo to the hair insert 48 or using a halo insert in place of insert 48. A devil could be made by substituting horns for the hair insert.

Figure 11:
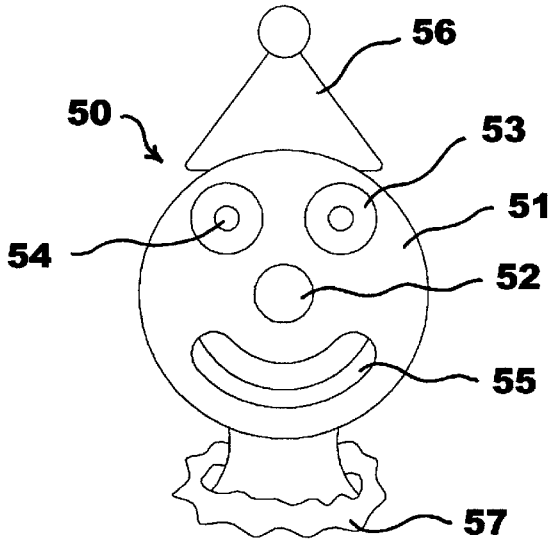
FIG. 11 is a top plan view of a fourth present preferred embodiment.

A fourth present preferred embodiment 50 shown in FIG. 11 is in the shape of a clown having a plastic body 51 with a molded plastic nose 52. The eyes 53 are similar to the eyes 43 in the embodiment of FIG. 9. However, in this embodiment there is no hole in the eye. Rather there is a dark plastic bead 54 within the eye 53 similar to insert 47 in eye 43. In addition to providing a pleasing visual appearance to the eyes, the inserts 47 and 54 may rattle within the eyes if the decorative magnet 40 or 50 is shaken. Mouth 55 can be formed by a second insert of a different color from the body and the eyes. That insert may have a bridge (not shown) that connects the mouth to a hat 56 and a neck and collar 57. Slots would be provided in the side walls to accommodate the connecting bridge as it extends from the hat or the neck and collar into the body.

Figure 12:
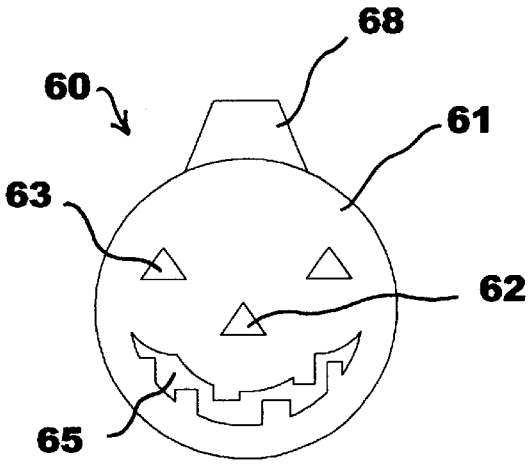
FIG. 12 is a top plan view of a fifth present preferred embodiment.
Figure 13:
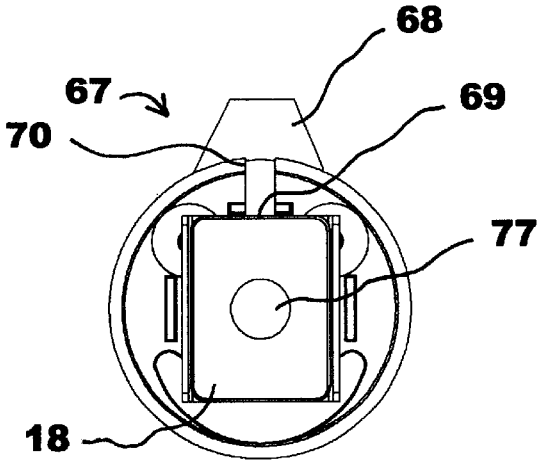
FIG. 13 is a rear view of the embodiment shown in FIG. 12.
Figure 14:
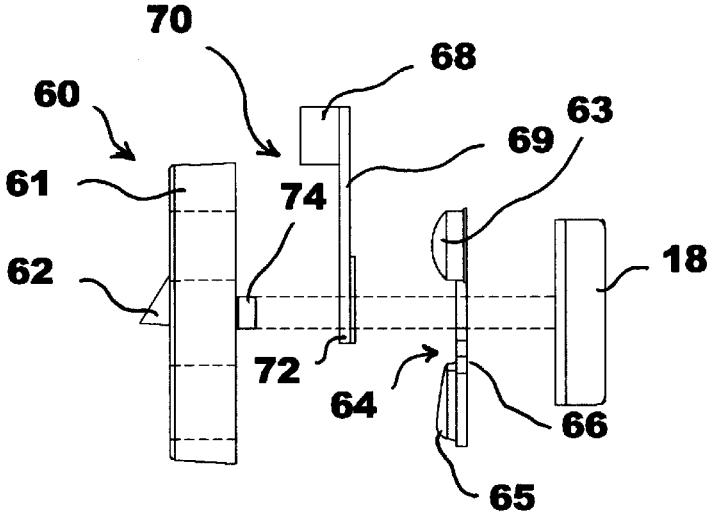
FIG. 14 is an exploded side view of the embodiment shown in FIGS. 12 and 13.
Figure 15:
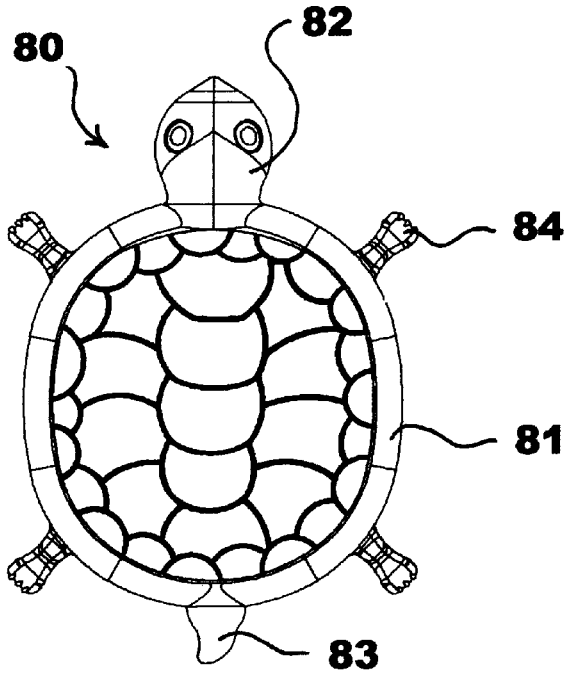
FIG. 15 is a top plan view of a sixth present preferred embodiment.

A fifth present preferred embodiment shaped as a pumpkin 60 is shown in FIGS. 12, 13 and 14. This embodiment has a plastic body 61 with a molded nose 62. Eyes 63 and mouth 65 are formed by an insert 64 that fits in holes through the body 61. A bridge 66 connects the mouth 65 to the eyes 63 to form insert 64. Stem 68 is formed by a different insert 67 which has a bridge 69 that extends through slot 70 to a position behind magnet 18. This stem 69 has a ring portion 72 that fits over the stake 74 extending from the rear of body 61. After the stem insert 69 and the eyes and mouth insert 64 are positioned over the stake, magnet 18 is fitted onto the stake. Then the end of stake 74 is heated to form head 77 thereby heat staking the magnet onto the body. In this embodiment, the body is orange, the eyes are yellow and the stem is green.

I prefer to mold the body and inserts from polypropylene, but other plastics could be used. Such plastics include polycarbonate, polyethylene, polystyrene, polyvinylchloride and nylon.

Whether the decorative magnet has a single insert as does the first present preferred embodiment or multiple inserts like the embodiment shown in FIGS. 12, 13 and 14, assembly is quick and easy and can be automated. The inserts open up endless possibilities for inexpensive decorative magnets made of several pieces in multiple colors.

While the embodiments shown in FIGS. 1 through 14 utilize a cylindrical plastic body and have a face it should be distinctly understood that the body could have any shape and that other decorative objects such as Christmas trees, animal heads or bodies and flowers could be made in accordance with the present invention. One such structure is a turtle 80 shown in FIG. 15. In this embodiment, the body 81 is similar to the bodies used in previous embodiments and has a single magnet (not shown) attached to the rear surface of the body 81. The front or face of body 81 is shaped like a turtle shell. One or more inserts similar to insert 69 in the embodiment of FIG. 14 is attached to body 81 and forms the head 82, tail 83 and legs 84 of the turtle.

Figure 16:
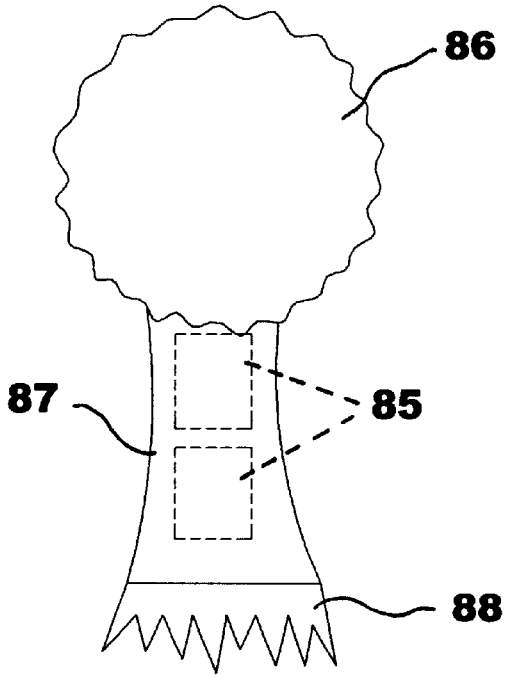
FIG. 16 is a top plan view of a seventh present preferred embodiment.
Figure 17:
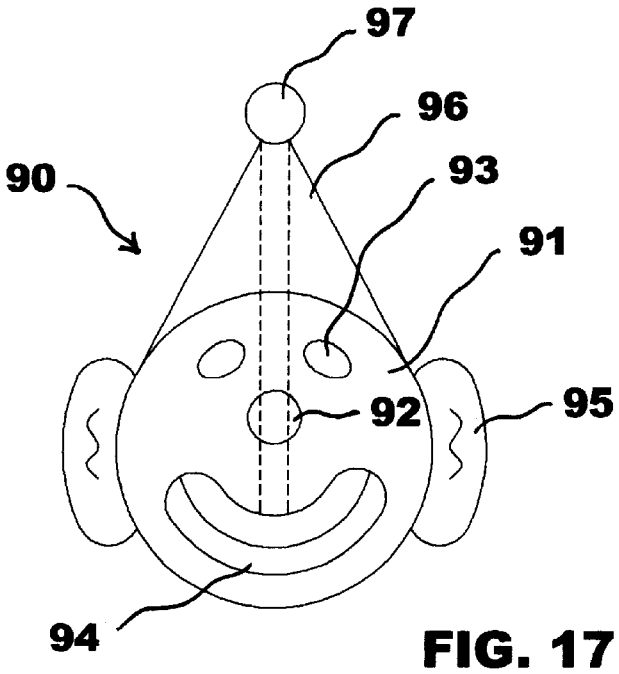
FIG. 17 is a top plan view of an eighth present preferred embodiment.
Figure 18:
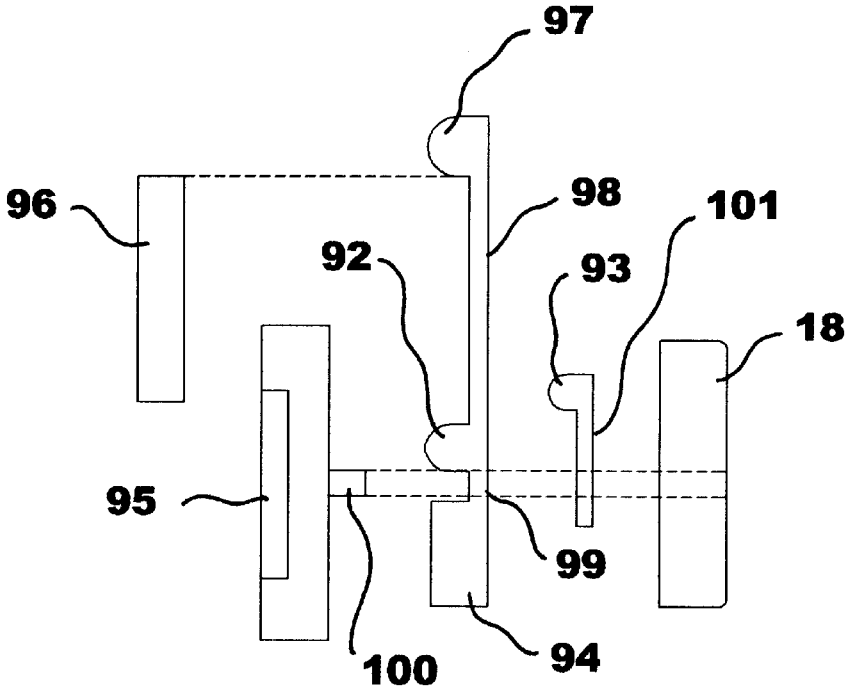
FIG. 18 is an exploded side view of the embodiment shown in FIG. 17.

Yet another embodiment shown in FIG. 16 has an elongated body 87 shaped like a tree trunk. Two magnets 85 are attached to the rear of the body. One insert creates the roots 88 and a second insert 86 creates the leaf covered branches. The inserts and magnets are attached to the body 87 in the same manner as in the embodiment of FIGS. 12, 13 and 14.

In the first embodiment the large nose is used to grip the magnet and remove the product from a metal surface. A smaller nose, such as the nose 52 on the clown embodiment shown in FIG. 11, may not be large enough to be easily gripped. Consequently, one may provide a rim extending outwardly from the perimeter of the body much like the brim of a hat. Alternatively, one or more projections could be molded only around a portion of the circumference of the body. The rim or projections will permit the decorative magnet to be easily gripped and removed from a metal surface. In another embodiment 90, shaped like a clown and shown in FIGS. 17 and 18, the body 91 is the clown face. Holes are provided in the face for a nose 92, eyes 93 and a mouth 94. Ears 95 are molded as part of the body 91 and provide projections that can be easily gripped to lift the magnet from a metal surface. The nose 92 and mouth 94 are part of a single insert that also contains the tassel 97 on hat 96. The mouth 94 is attached to the nose 92 by a bridge 99 that fits around stake 100. Bridge 98 connects the tassel 97 to the nose 92. The insert that carries the mouth, nose and tassel preferably is red, while the body 91 and ears are another color. The eyes are connected together by a V-shaped bridge 101 whose lower portion fits around stake 100. As in the previous embodiments a magnet 18 fits over at least a portion of the inserts and secures them to the body. The clown hat 96 fits over the top of the body 91 and snap fits onto bridge 98. That bridge passes through a slot in the edge of the body.

Figure 19:
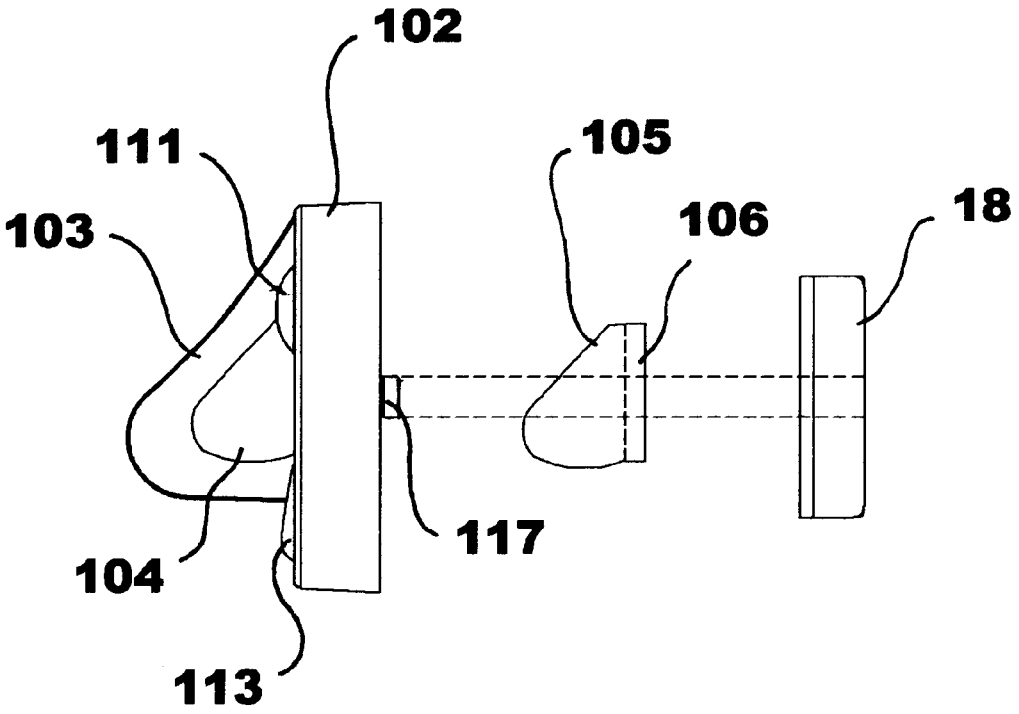
FIG. 19 is an exploded side view of a ninth preferred embodiment similar to the first embodiment.
Figure 20:
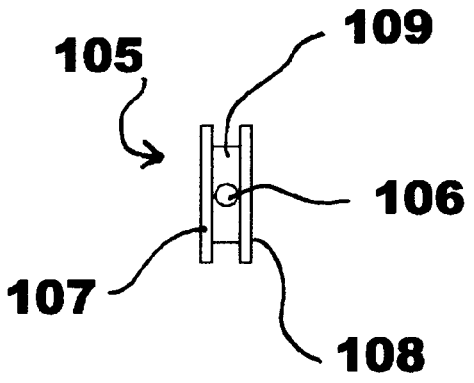
FIG. 20 is a top plan view of an insert used in the embodiment of FIG. 19.

In all of the embodiments of FIGS. 1 through 18 the body obscured only the bridge portion of the inserts. However, in a ninth present preferred embodiment shown in FIG. 19 the body extends over a portion of the insert that projects from the face. The body 102 with eyes 111 and mouth 113 is similar in appearance to the body 2 in the first embodiment shown in FIG. 1. However, the nose 103 has a transverse opening 104. Insert 105 fits into opening 104. As can be seen most clearly in FIG. 20 the insert 105 has two parallel sides 107 and 108 connected by a web 109. The post 117 passes through hole 106 in the web. Magnet 18 fits onto the stack 117 securing the insert 105 in place.

While I have described and illustrated certain present embodiments of my decorative magnet it should be distinctly understood that the invention is not limited thereto, but may be variously embodied within the scope of the following claims.

I claim:

1. A plastic object comprised of:

a plastic body having a front surface and a rear surface, the body having at least one opening extending through the body from the front surface to the rear surface and a stake extending from the rear surface of the body;

an insert having a first portion within the at least one opening and a second portion extending from the first portion, the second portion resting against the rear surface of the body and preventing the insert from completely passing through the opening; and a magnet having a hole, the magnet sized and positioned such that the stake passes through the hole and is heat staked to retain the magnet on the stake and at least a portion of the magnet covers at least a portion of the insert thereby retaining the insert within the at least one opening.

2. The plastic object of claim 1 wherein the body is comprised of a flat portion and a side portion extending from the flat portion, the front surface being comprised of a surface of the flat portion and a surface of the side portion.

3. The plastic object of claim 2 wherein the at least one opening is comprised of a first opening through the flat portion of the body and a second opening through the side portion of the body.

4. The plastic object of claim 2 wherein the side portion contains at least one opening and the at least one insert passes through the at least one opening in the side portion.

5. The plastic object of claim 1 wherein the body and the insert are different colors.

6. The plastic object of claim 1 wherein the first portion of the insert contains a cavity and further comprising a second insert within the cavity, and wherein the cavity has an opening and the magnet extends over at least a portion of that opening.

7. The plastic object of claim 6 wherein the first portion of the insert is a transparent or translucent plastic.

8. The plastic object of claim 6 wherein the first portion of the insert has a hole extending from the cavity, the hole being smaller than the second insert such that the second insert cannot pass through the hole.

9. The plastic object of claim 1 wherein the body is cylindrical having a round, flat portion and an encircling side portion and the at least one opening is two similarly sized holes positioned to define eyes and further comprising a nose extending from the face below the eyes.

10. The plastic object of claim 9 wherein the round, flat portion contains a slot defining a mouth and the at least one insert extends through the slot.

11. The plastic object of claim 9 wherein the encircling side portion contains at least one slot through which a portion of the insert extends, that portion configured to define at least one of an ear, a neck, a collar, hair and a hat.

12. The plastic object of claim 1 wherein the back of the body contains at least one channel and the second portion of the insert is within the at least one channel.

13. The plastic object of claim 1 wherein the body is comprised of a flat portion having a perimeter and a side portion normal to the flat portion and extending around the perimeter of the flat portion further comprising at least one projection extending from the side portion.

14. The plastic object of claim 13 wherein the projection extends around the perimeter of the flat portion.

15. The plastic object of claim 1 also comprising:

a second stake extending from the rear surface of the body, a second magnet having a hole, the magnet sized and positioned such that the stake passes through the hole and is heat staked to retain the second magnet on the second stake.

16. The plastic object of claim 1 wherein the first portion of the insert extends through the at least one opening in the body forming an exposed portion of the insert and a portion of the body extends over part of the exposed portion of the insert.

17. The plastic object of claim 1 wherein the body is comprised of a flat portion having a perimeter and a side portion attached to and extending from the perimeter, the side portion having a slot through which the second portion of the insert passes to a point outside of the body creating an extension portion which is outside the body and further comprising a decorative member attached to and covering the extension portion.

18. A plastic object comprised of:

a plastic body having a front surface and a rear surface, the body having at least one opening extending through the body from the front surface to the rear surface and at least two stakes extending from the rear surface of the body;

an insert having a first portion within the at least one opening and a second portion extending from the first portion, the second portion resting against the rear surface of the body and preventing the insert from completely passing through the opening; and at least two magnets, each magnet having a hole, the magnet sized and positioned such that one of the stakes passes through the hole and is heat staked to retain the magnet on the stake and at least a portion of at least one of the two magnets covers at least a portion of the insert thereby retaining the insert within the at least one opening.

19. The plastic object of claim 18 wherein the body is comprised of a flat portion and a side portion extending from the flat portion, the front surface being comprised of a surface of the flat portion and a surface of the side portion.

20. The plastic object of claim 19 wherein the at least one opening is comprised of a first opening through the flat portion of the body and a second opening through the side portion of the body.

21. The plastic object of claim 19 wherein the side portion contains at least one opening and the at least one insert passes through the at least one opening in the side portion.

22. The plastic object of claim 18 wherein the body and the insert are different colors.

* * * * *